US008439345B2

(12) United States Patent
Inoue et al.

(10) Patent No.: US 8,439,345 B2
(45) Date of Patent: May 14, 2013

(54) IMAGE FORMING DEVICE

(75) Inventors: Hideaki Inoue, Ibaraki-ken (JP); Hirokazu Yabune, Ibaraki-ken (JP); Masaaski Saitou, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 13/548,959

(22) Filed: Jul. 13, 2012

(65) Prior Publication Data

US 2013/0015620 A1 Jan. 17, 2013

(30) Foreign Application Priority Data

Jul. 15, 2011 (JP) ..... P2011-156498

(51) Int. Cl.
*B65H 5/00* (2006.01)

(52) U.S. Cl.
USPC ..... 271/10.01; 271/10.02; 271/10.03; 271/242; 271/258.01; 271/265.01

(58) Field of Classification Search ..... 271/10.01, 271/10.02, 10.03, 242, 258.01, 265.01
See application file for complete search history.

(56) References Cited

U.S. PATENT DOCUMENTS 6,637,852 B2 * 10/2003 Bjune ..... 347/16

FOREIGN PATENT DOCUMENTS

JP 2000-327150 A 11/2000

* cited by examiner

*Primary Examiner* — David H Bollinger
(74) *Attorney, Agent, or Firm* — Nath, Goldberg & Meyer; Jerald L. Meyer

(57) ABSTRACT

An image forming device including a pickup roller and a scraper roller configured to send out a print sheet to a feed route, a before-registration roller configured to send out a print sheet to a registration roller, and a control unit configured to independently control the transfer speed of the print sheet at each point based on operation patterns relating to the pickup roller and the scraper roller, and an intermediate transfer roller configured to transfer the print sheet between the before-registration roller and itself, wherein the operation pattern is set based on a relationship between a distance from the intermediate transfer roller to the before-registration roller or a distance from the intermediate transfer roller to the registration roller and a length of the print sheet.

8 Claims, 10 Drawing Sheets

IMAGE FORMING DEVICE

BACKGROUND OF THE INVENTION

1. Technical Field

The present invention relates to an image forming device having a feed route to feed a recording medium from a feed tray to a transfer route and forming an image on the recording medium transferred on the transfer route.

2. Background Arts

An inkjet image forming device adopts a mechanism which disposes a registration roller at the upstream of an image former on a transfer route, temporarily holds a recording medium supplied from a scraper roller and a pickup roller configured to transfer a recording medium stacked on a feed tray one by one, and adjusts a timing to send out the recording medium to the transfer route. Further, in such an image forming device, a large-capacity feed unit in which a number of recording media are stacked is installed in an attachable/detachable manner, or is incorporated in equipment in order to perform printing processing of a large number of recording media of equal size.

In this large-capacity feed unit, it is necessary to secure a maintenance space, such as a space for eliminating a paper jam on the feed route, and thus a plurality of intermediate transfer rollers is disposed between the pickup roller and the registration roller in order to secure to some extent the distance from the pickup roller to the registration roller and also to stably transfer recording media of various sizes.

In the image forming device described in Japanese Patent Application Laid-Open No. 2000-327150, an intermediate transfer roller is driven by an electromagnetic clutch driven by the action of an electromagnetic force using an electromagnet or a one-way clutch that transmits a rotational force only in one direction. In the case where such an electromagnetic clutch or one-way clutch is used, when the registration roller provided at the downstream side nips a recording medium, the drive of the intermediate transfer roller is brought into the off state and after that, by causing the intermediate transfer roller to rotate idly (so-called "accompanying rotational motion") in accordance with the sheet transfer by the registration roller, the recording medium is prevented from traveling in the opposite direction of the transfer direction toward the upstream.

SUMMARY OF THE INVENTION

However, when the intermediate transfer roller is caused to perform accompanying rotational motion, the recording medium is gripped by friction between the intermediate transfer roller and the recording medium as a result, and there used to occur back tension in the recording medium. The back tension has a possibility to cause a delay in the transfer timing, deviation in the image position, and a paper jam and at the same time, when a delay occurs in the transfer timing, there used to be such a problem that the speed of image formation processing is prevented from increasing.

The present invention has been made in view of the above-mentioned circumstance and an object thereof is to provide an image forming device capable of reducing back tension that occurs in a recording medium in the previous stage of the registration roller.

In order to achieve the above-mentioned object, an image forming device according to an embodiment of the present invention is an image forming device having a feed route to feed a recording medium from a feed tray to a transfer route and forming an image on the recording medium transferred on the transfer route, characterized by including a pickup roller configured to pick up the recording medium stacked on the feed tray and to send out the recording medium to the feed route, a registration roller configured to adjust the timing to send out the recording medium to the transfer route, an intermediate transfer roller group configured to transfer the recording medium between the pickup roller and the registration roller, an operation pattern storage unit configured to store operation patterns of the pickup roller, the intermediate transfer roller group, and the registration roller, and a controller configured to control the transfer speeds of the recording medium independently at respective points where the pickup roller and the intermediate transfer roller group are disposed based on the operation patterns, wherein the operation pattern is set based on a relationship between the distance on the transfer route among at least two rollers in the intermediate transfer roller group and the length of the recording medium in the transfer direction.

DESCRIPTION OF THE EMBODIMENTS (General Configuration of Printer)

Figure 1:
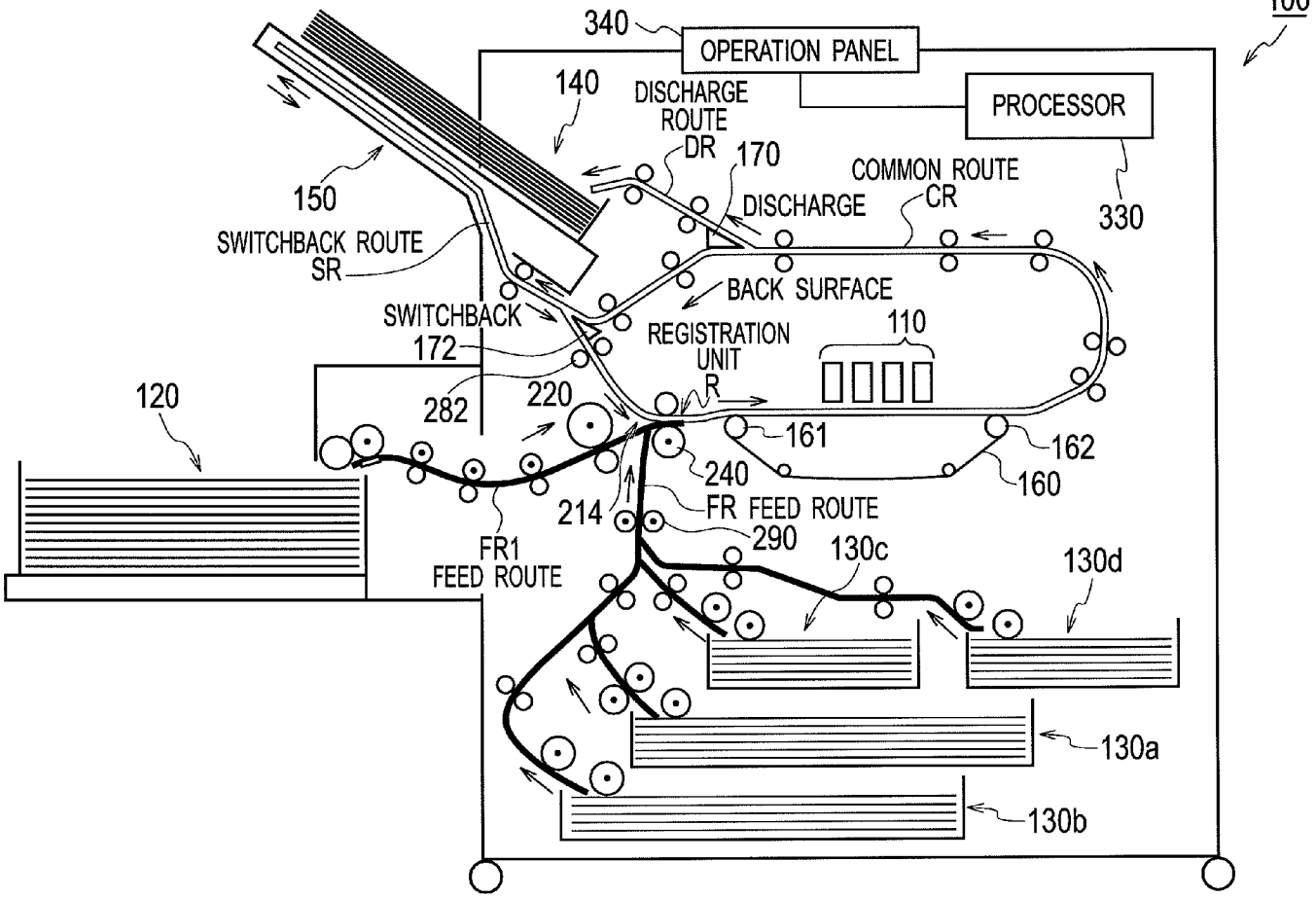
FIG. 1 is a schematic diagram of a print sheet transfer route in a printer according to an embodiment of the present invention.

An embodiment of the present invention will be explained below with reference to the drawings. FIG. 1 is a schematic diagram of a print sheet transfer route in a printer according to a first embodiment of the present invention. In the drawings, the number of rollers configuring a drive unit is omitted arbitrary.

A printer (image forming device) 100 of the present embodiment is an inkjet line color printer including a plurality of ink heads in which a number of nozzles are formed. The printer 100 performs printing in units of lines by ejecting a black or color ink from each ink head and forms a plurality of images on a recording sheet on the transfer belt in an overlapping manner.

The printer 100 forms an image on a print sheet 10 transferred on an annular transfer route as shown in FIG. 1. This transfer route includes a feed route FR to supply a sheet, a common route CR that runs from the feed route FR to a discharge route DR via a head unit 110, and a switchback route SR connected to the common route CR as a branch.

As feed mechanisms to supply the print sheet 10 to the feed route FR, there are provided a side feed tray 120 provided outside the case side surface and configured to store the print sheets 10 in a stacked state and a plurality of feed trays (130*a*, 130*b*, 130*c*, 130*d*) provided inside the case.

The print sheet 10 fed from one of the feed mechanisms, the side feed tray 120 and a feed tray 130, is transferred along the feed route FR within the case by a drive mechanism, such as a roller, and guided to a registration unit R, which is a reference position of the head part of the print sheet. Then, the operation to supply the print sheet to a registration roller of the registration unit R is performed by the drive of each roller located at the upstream of the registration roller.

On the other hand, at the downstream side in the transfer direction of the registration unit R, the head unit 110 including a plurality of print heads is provided. While the print sheet 10 is transferred at a speed determined by printing conditions by a transfer belt 160 provided on the surface in opposition to the head unit 110, an image is formed in units of lines by an ink ejected from each print head. The printed print sheet 10 is further transferred on the common route CR by a drive mechanism, such as a roller. To the common route CR, as a discharge mechanism to discharge the printed print sheet 10, a discharge opening 140 is connected as a branch.

Then, in the case of one-sided printing in which only one side of the print sheet 10 is printed, the print sheet 10 is guided to the discharge opening 140 through the discharge route DR as it is and discharged therefrom and is stacked on a discharge table 150 provided as a reception table of the discharge opening 140 with its printed side facing downward. The discharge table 150 has the shape of a tray protruding from the case and has a thickness of a certain magnitude. The discharge table 150 is inclined and the print sheet 10 discharged from the discharge opening 140 is automatically aligned and stacked by a wall formed at the bottom position of the inclined surface.

On the other hand, in the case of duplex printing in which both sides of the print sheet 10 are printed, when printing of the surface (hereinafter referring to the side printed first as a "surface" and the side printed next as a "back surface") is completed, the print sheet 10 is not guided to the discharge route DR side but further transferred within the case and sent out to the switchback route SR. At the branching point of the discharge route DR and the switchback route SR, a switching mechanism 170 to switch the transfer routes for printing the back surface is provided and by the switching mechanism 170, the print sheet 10 not sent out to the discharge route is fed into the switchback route SR.

In the switchback route SR, the sheet is passed from the common route CR and so-called switchback to switch back the surface and the back surface of the sheet is performed by reciprocating the sheet. Then, by a drive mechanism, such as a roller, the sheet is returned to the common route CR via a switching mechanism 172 and re-fed through the registration unit "R" and printing of the back surface is performed by the same procedure as that of the surface. After that, the print sheet 10, the back surface of which is printed and on both sides of which images are formed, is guided to the discharge opening 140 through the discharge route DR and discharged therefrom and stacked on the discharge table 150 provided as a reception table of the discharge opening 140. In the present embodiment, the switchback at the time of duplex printing is performed by making use of a space provided within the discharge table 150. The space provided within the discharge table 150 has a configuration that is covered so as to prevent the print sheet 10 from being taken out from outside at the time of switchback.

In the printer 100, to the registration unit "R" that serves as a reference position of the head part of the fed print sheet 10, the print sheet 10 one side of which is already printed is also re-fed at the time of duplex printing. Because of this, at a portion immediately before the registration unit "R", a confluence point 214 is formed where the feed route of the print sheet 10 to be fed newly and a re-feed route through which the print sheet the back surface of which is to be printed is circulated and transferred meet together. Then, the registration unit "R" sends out the sheet at the downstream side of the confluence point 214 of the feed route FR and the common route CR.

Further, in the present embodiment, after a print sheet 10 is fed, not that the print sheet 10 is printed and discharged and then the next print sheet 10 is fed, but that by scheduling, the successive print sheet 10 is fed before the preceding print sheet 10 is discharged, and thereby, it is possible to perform printing continuously at predetermined intervals. Consequently, in the normal scheduling at the time of duplex printing, a space is secured in advance so that a position is secured into which the sheet returned from the switchback route SR is inserted when the sheet the surface of which is to be printed is fed. Due to this, in the present device, it is possible to perform printing of the surface and printing of the back surface parallel, and therefore, it is possible to assure productivity twice that at the time of one-sided printing.

The transfer belt 160 is hung between a drive roller 161 and a driven roller 162 disposed at the front end and the rear end of the surface facing the head unit 110 in the common route CR and in FIG. 1, the transfer belt 160 rotates and moves in the clockwise direction. Further, on the top surface of the transfer belt 160, ink heads of four colors are disposed side by side along the direction in which the belt moves and the head unit 110 for forming a color image by overlapping each color image is disposed in opposition thereto.

Further, as shown in FIG. 1, the printer 100 includes a processor 330. The processor 330 is a module configured by hardware, such as a processor, such as a CPU and DSP (Digital Signal Processor), memory, and other electronic circuits, or software, such as programs having the functions thereof, or combinations of the hardware and the software. Then, the processor 330 virtually constructs various kinds of functional modules by appropriately reading and executing programs, and performs processing relating to image data, operation control of each unit, and various kinds of processing in response to user's operations by each constructed functional module. Further, to the processor 330, an operation panel 340 is connected and through the operation panel 340, it is possible to receive an instruction and setting operation by a user.

(Feed Mechanism)

Figure 2:
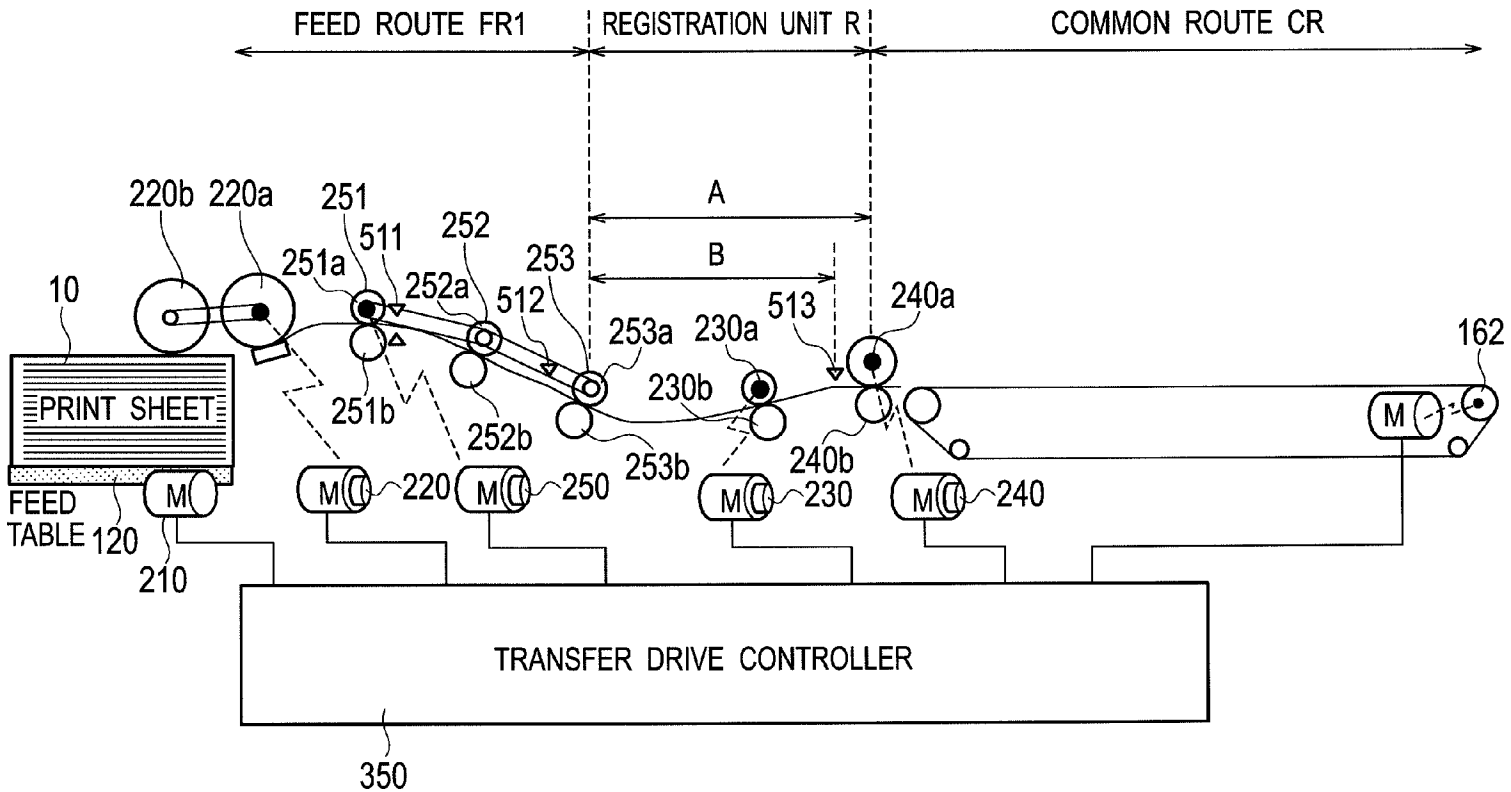
FIG. 2 is an enlarged view of part of a feed route of FIG. 1.

In the present embodiment, the feed route FR described above includes a feed mechanism. FIG. 2 is an enlarged view of part of the feed route FR.

As shown in FIG. 2, this feed mechanism is provided as part of the feed route FR described above and is a mechanism to send out the print sheet 10 to the registration unit "R". Then, in the present embodiment, the sheet is supplied to the registration unit "R" through a feed route FR1 to newly feed a sheet from the side feed tray 120 provided outside the side surface of the case.

In the registration unit "R", registration rollers 240*a* and 240*b* are disposed at the upstream of the head unit 110 in the common route CR and the registration rollers 240*a* and 240*b* hold temporarily the print sheet 10 that enters the common route CR from the feed route FR side and adjust the timing to send out the print sheet 10 to the head unit 110. Further, in the registration unit "R", before-registration rollers 230*a* and 230*b* are disposed adjacent to each other at the upper stream side of the transfer route than the registration rollers 240*a* and 240*b* and the print sheet 10 is sent out from the feed route FR1 to the registration rollers.

On the side feed tray 120, a plurality of the print sheets 10 is stacked and stored. Then, a scraper roller 220*b* at the upstream side and a pickup roller 220*a* at the downstream side are provided to send out the stacked print sheets 10 and when these rollers rotate, the print sheet 10 is taken out one by one from the uppermost print sheet 10 of the stacked print sheets 10 and sent out to the feed route FR1. Further, the side feed tray 120 is provided with an elevator mechanism 210 to move the feed table vertically. The elevator mechanism lifts and lowers the stacked print sheets 10 by transmitting the drive force to the tray bottom plate to move the plate vertically.

The feed route FR1 is a feed route to transfer the print sheets 10 stacked on the side feed tray 120 that stores print sheets in a stacked state to the registration unit "R". In the feed route FR1, a plurality of intermediate transfer rollers 251 (251*a*, 251*b*), 252 (252*a*, 252*b*), and 253 (253*a*, 253*b*) to transfer the print sheet 10 between the pickup roller 220*a* and the before-registration roller 230*a* (230*b*) is provided along the feed route and the print sheet 10 picked up from the tray 120 is sent out to the registration unit R.

In the present embodiment, of the plurality of the intermediate transfer rollers 251, 252 and 253, only the intermediate transfer roller 251 located at the upstream side of the feed route is driven directly by the intermediate transfer motor and the other intermediate transfer rollers 252 and 253 are driven and rotated by the power transmitted by a belt pulley mechanism.

In the present embodiment, the before-registration rollers 230*a* and 230*b* and the intermediate transfer rollers 251, 252 and 253 constitute the components of the intermediate transfer roller group.

(Feed Control Mechanism)

Figure 3:
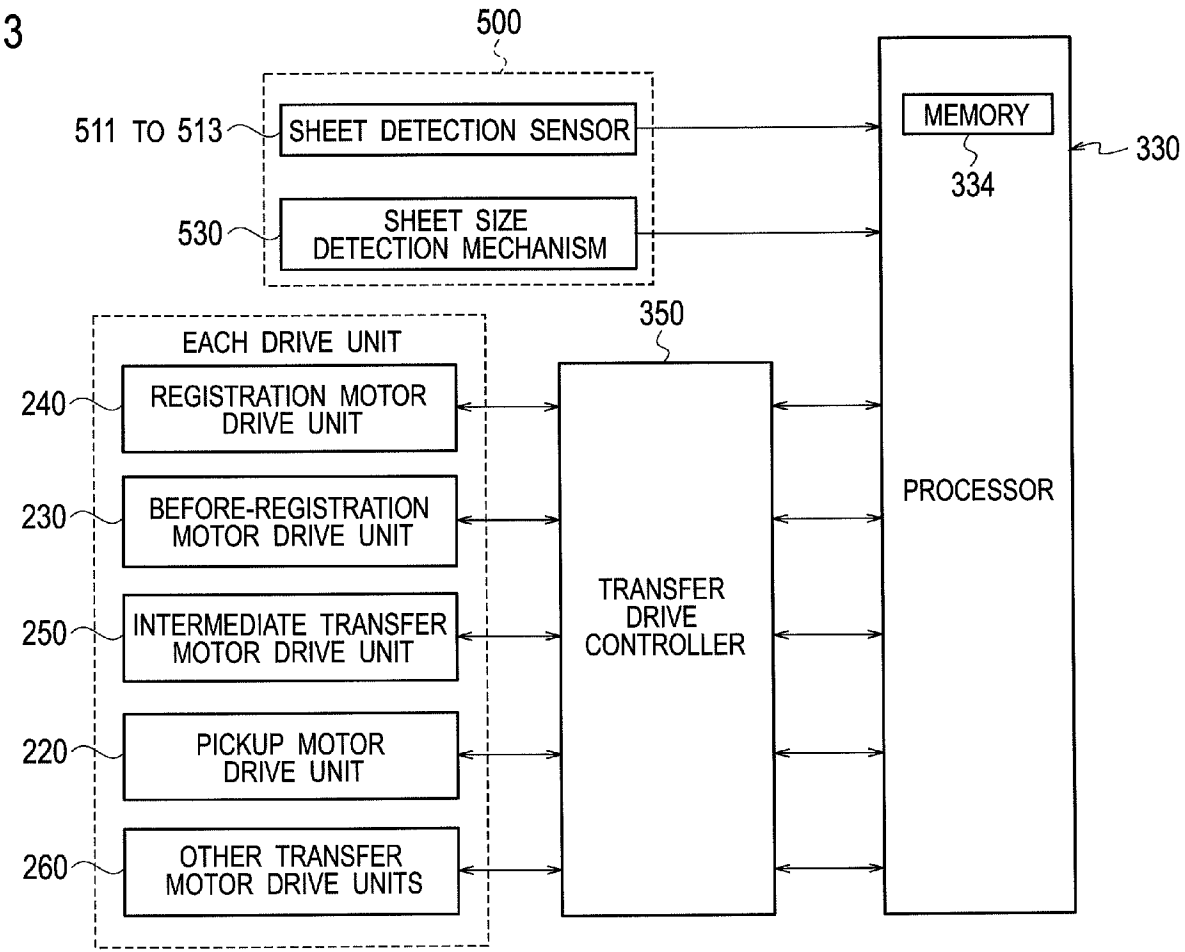
FIG. 3 is a block diagram showing a module relating to feed control of a processor of FIG. 1 and peripherals thereof.
Figure 4:
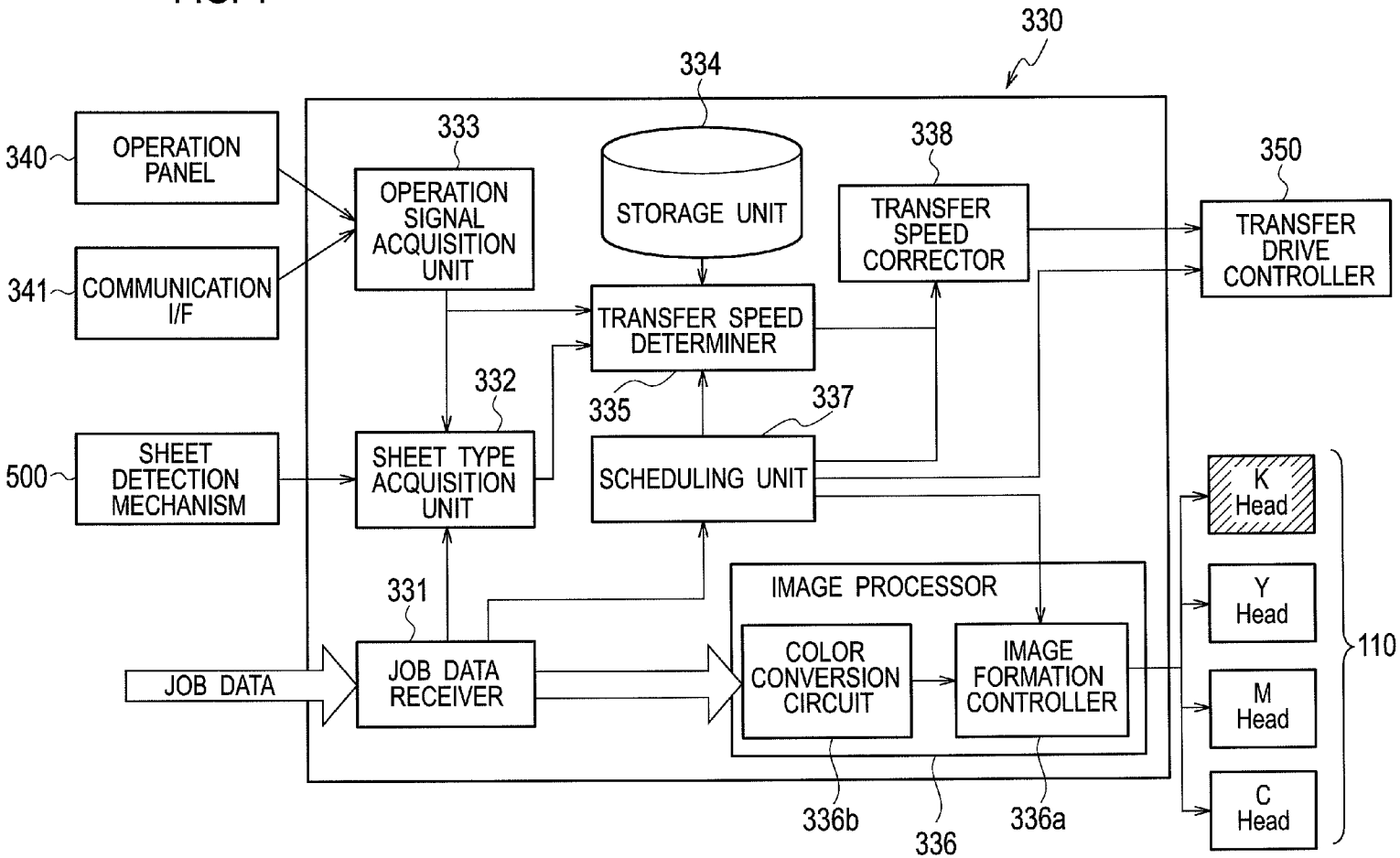
FIG. 4 is a block diagram showing a module relating to feed control of the processor of FIG. 3.

Transfer drive control in each transfer route is performed by the processor 330 described above. FIG. 3 is a block diagram showing a module relating to feed control of the processor 330 and peripherals thereof and FIG. 4 is a block diagram showing modules relating to the feed control of the processor 330. Here a "module" refers to a unit of function to achieve a predetermined operation, which is configured by hardware, such as a device and equipment, or software having the functions thereof, or a combination of the hardware and the software. As shown in FIG. 3, as modules relating to the feed control mechanism, there are provided a sheet detection module group 500 and a transfer drive controller 350 to control each drive unit in addition to the processor 330.

(1) Sheet Detection Module Group

The sheet detection module group 500 is a module group configured to acquire information about the print sheet 10 involved in transferring and includes sheet detection sensors 511 to 513 and a sheet size detection mechanism 530.

As shown in FIG. 2, the sheet detection sensors 511 to 513 are disposed in the feed route FR1 and in the registration unit R, respectively, and are configured to detect presence/absence (passing) of the print sheet 10 involved in feeding and to detect the size, kind, or thickness of the print sheet 10. The detected data is sent out to the processor 330.

In the present embodiment, the intermediate entrance sensor 511 and the intermediate exit sensor 512 are provided in the feed route FR1. The intermediate entrance sensor 511 is installed in close proximity to the intermediate transfer roller 251 at the upstream side within the feed route FR1 and configured to detect the arrival of the print sheet 10 at the feed route FR1. The intermediate exit sensor 512 is installed in close proximity to the intermediate transfer roller 253 at the downstream side within the feed route FR1 and configured to detect the passing of the print sheet 10 from the feed route FR1.

Further, the registration unit R is provided with the registration sensor 513. The registration sensor 513 is installed in close proximity to the upstream side of the registration rollers 240*a* and 240*b* and configured to detect the arrival of the print sheet 10 at the registration rollers 240*a* and 240*b*. In the present embodiment, it is possible to use other various kinds of sensors, such as a reflective sensor and a transmission sensor, as a sheet detection sensor.

The sheet size detection mechanism 530 is a module configured to acquire the size of a sheet to be transferred in the feed route FR. The sheet size detection mechanism 530 acquires the size of the sheet involved in transfer processing by reading the sheet setting in the printer driver or at the operation panel 340 performed by a user, the time when the sheet passes by the sheet size sensor of the feed tray and the sensor in each transfer route within the printer 100, and transmits the acquired sheet type data to the processor 330.

The printer driver is an application or middleware executed by each client PC on the network when, for example, the present printer is utilized like a network printer. It is possible for the printer driver to transmit the print data and execution instruction to the printer 100 through a communication interface, such as a LAN. In the present embodiment, the printer driver is provided with an interface for setting the kind of sheet and it is possible for a user to select a kind of sheet by selecting an item on the interface. In the sheet size detection mechanism 530, information, such as the sheet type, sheet thickness, and sheet size, is acquired in accordance with the selection of the kind of sheet.

The transfer drive controller 350 is a module configured to control transfer in each transfer route and to receive data transmitted from the processor 330 and control each drive unit within the transfer route based on the data.

(2) Transfer Drive Controller Module

As drive units relating to the feed route 1-R1 and the registration unit "R", there are included a registration motor drive unit 240 of the registration rollers 240*a* and 240*b*, a before-registration motor drive unit 230 of the before-registration rollers 230*a* and 230*b*, an intermediate transfer motor drive unit 250 of the intermediate transfer rollers 251, 252 and 253, a pickup motor drive unit 220 configured to drive the pickup roller 220*a* and the side feed tray 120, and motor drive units of other transfer rollers.

The registration motor drive unit 240 of the registration rollers 240*a* and 240*b* is a drive unit disposed at the upstream of an image former of the transfer route and configured to hold the print sheet 10 involved in feeding by a pair of rollers and to adjust the timing (time) to send out the print sheet 10 to the image former. The motor drive unit 240 is controlled by the transfer drive controller 350 so that the start and stop of the operation of the registration drive unit and the operation speed are controlled and further, the acceleration at the time of start and the deceleration at the time of speed reduction are controlled.

The before-registration motor drive unit 230 of the before-registration rollers 230*a* and 230*b* is a drive unit disposed at the upstream of the registration rollers 240*a* and 240*b* of the transfer route and configured to hold the print sheet 10 involved in feeding by a pair of rollers, to adjust the timing to send out the print sheet 10 to the image former, and to perform so-called "push-to-align correction control" to correct the inclination of the sheet by sending out the sheet to the post stage after correcting the sheet transferred in an inclined state to an upright state.

The pickup motor drive unit 220 of the pickup roller 220*a* is a drive unit configured to pick up the print sheet 10 stacked on the side feed tray 120 within the feed route FR1 communicated with the registration unit R from the side feed tray 120 exposed to the outside of the side surface of the printer 100 and to transfer the print sheet 10 to the before-registration rollers 230*a* and 230*b*. The intermediate transfer motor drive unit 250 of the intermediate transfer rollers 251, 252 and 253 is a drive unit disposed in the feed route FR1 and configured to hold the print sheet 10 involved in feeding by a pair of rollers disposed in plurality and to adjust the timing to send out the print sheet 10 to the registration unit "R".

Other transfer rollers include a common transfer roller 290, a switchback roller 281, a re-feed roller 282. Then, a transfer motor drive unit 260 that drives these transfer rollers is a drive unit configured to grip the print sheet 10 involved in feeding by a pair of rollers and to transfer the print sheet 10 to the registration unit "R". Further, the transfer motor drive unit 260 also includes a drive motor that drives the driven roller 162 disposed at the rear end of the transfer belt 160. Then, the transfer motor drive unit 260 transfers the print sheet 10 transferred from the registration unit R by the transfer belt 160 at a speed determined by the printing condition by driving the driven roller 162.

In the present embodiment, the transfer drive controller 350 controls the start and stop of the operation of each drive unit and the operation speed independently.

(3) Processor

The feed control in the present embodiment is performed by the processor 330 controlling the operation of each drive unit based on the transfer condition in each route and the sheet type.

As shown in FIG. 4, the processor 330 includes a job data receiver 331, a sheet type acquisition unit 332, an operation signal acquisition unit 333, a transfer speed corrector 338, a scheduling unit 337, an image processor 336, a transfer speed determiner 335, and a storage unit 334.

The job data receiver 331 is a communication interface configured to receive job data, which is a unit of a series of printing processing, and also a module configured to pass data included in the received job data to the scheduling unit 337 and the image processor 336. As communication here, short-distance communication is supposed, such as infrared communication, in addition to a LAN, such as an intranet (in-house network) and a domestic network by 10 BASE-T, 100 BASE-TX, etc.

The image processor 336 is a processing device that performs digital signal processing specialized in image processing and is also a module configured to perform conversion of image data etc. necessary for printing and to perform printing. The image processor 336 includes an image formation controller 336*a* and a color conversion circuit 336*b*.

The color conversion circuit 336*b* is a circuit configured to convert an RGB print image into a CMYK print image and to cause the image formation controller 336*a* to perform printing based on the print image of each color. The image formation controller 336*a* is a module configured to control the whole of image formation processing by controlling the drive of each color ink head and the operation of the drive unit of the transfer route and to form an image at the timing in accordance with scheduling by the scheduling unit 337 and the print speed.

The operation signal acquisition unit 333 is a module configured to receive an operation signal by a user through the operation panel 340 and to analyze the received operation signal and cause another module to perform processing in accordance with the user's operation. The sheet type acquisition unit 332 is a module configured to acquire the size, kind, or thickness of the print sheet 10 involved in feeding detected by the sheet detection module group 500 and the operation signal acquisition unit 333 as sheet type data. Then, at the time of printing processing, the sheet type acquisition unit 332 transmits the acquired sheet type data to the transfer speed determiner 335.

The storage unit 334 is a memory device configured to store and hold various kinds of data and programs and in the present embodiment, the storage unit 334 stores data of the operation patterns relating to the pickup roller 220*a*, the scraper roller 220*b*, the intermediate transfer rollers 251, 252 and 253, and the before-registration rollers 230*a* and 230*b*. Then, at the time of printing processing, the storage unit 334 transmits the operation pattern in accordance with the selected sheet size to the transfer speed determiner 335.

In particular, in the present embodiment, the operation pattern includes control data with which to appropriately adjust the relative speed of each drive unit by synchronizing the operation speed of the intermediate transfer rollers 251, 252 and 253 with the start and stop of the drive and the behavior, such as sudden acceleration and sudden deceleration, of the pickup roller 220*a*, the scraper roller 220*b*, the registration rollers 240*a* and 240*b*, and the before-registration rollers 230*a* and 230*b*.

Then, the operation pattern that determines the operation speed of the intermediate transfer rollers 251, 252 and 253 is determined by the characteristics of the feed route including at least the distance from the intermediate transfer rollers 251, 252 and 253 configuring the intermediate transfer roller group to the before-registration rollers 230*a* and 230*b*, the length of the print sheet 10 in the transfer direction, and the following requirements (a) to (e).

It may be also possible to use the distance from the intermediate transfer rollers 251, 252 and 253 to the registration rollers 240*a* and 240*b* as the distance from the intermediate transfer rollers 251, 252 and 253 to the before-registration rollers 230*a* and 230*b* on the condition that the interval between the before-registration rollers 230*a*, 230*b* and the registration rollers 240*a*, 240*b* is already known.

(a) The delivery speed from the intermediate transfer rollers 251, 252 and 253 to the before-registration rollers 230*a* and 230*b* is made equal to the reception speed of the before-registration rollers 230*a* and 230*b*.

(b) In the section in which one print sheet 10 is transferred between the intermediate transfer rollers 251, 252 and 253 and the before-registration rollers 230*a* and 230*b*, the rotational speed of the intermediate transfer rollers 251, 252 and 253 is made equal to that of the before-registration rollers 230*a* and 230*b*.

(c) After the rear end of the print sheet 10 exits from the intermediate transfer rollers 251, 252 and 253, the rotational speed of the intermediate transfer rollers 251, 252 and 253 is made equal to the rotational speed of the pickup roller 220*a* and the scraper roller 220*b*.

(d) In the case of the configuration having the three intermediate transfer rollers 251, 252 and 253, the print sheet 10 for the next page is prevented from entering the intermediate transfer roller 251 at the upstream side until the rear end of the sheet exits from the intermediate transfer roller 253 at the downstream side.

(e) The before-registration rollers 230*a* and 230*b* perform the push-to-align speed correction at the time of detection by the registration sensor 513.

The transfer speed determiner 335 is a module configured to determine one of the plurality of operation patterns stored in the storage unit 334 by collating the sheet type data detected by the sheet detection module group 500 and the operation signal acquisition unit 333 with the schedule in the scheduling unit 337. Then, the transfer speed determiner 335 notifies the transfer speed corrector 338 of the determined operation pattern.

Further, the transfer speed determiner 335 also includes the function to correct a delay or advance in the arrival time of the print sheet 10 at the intermediate transfer rollers 251*a* and 251*b*. Specifically, the transfer speed determiner 335 transfers the print sheet 10 at a predetermined first speed V1 by the intermediate transfer roller 251 and also calculates a second speed V2 based on the characteristics of the feed route in accordance with the time when the intermediate entrance sensor 511 detects the front end of the print sheet 10, and corrects and controls the arrival time of the print sheet 10 at the before-registration rollers 230*a* and 230*b* by switching the first speed V1 to the second speed V2.

Further, the transfer speed determiner 335 performs control so that after the first speed V1 is switched to the second speed V2, the second speed V2 is switched to the first speed V1 at the time when the intermediate exit sensor 512 detects the front end of the print sheet 10. Furthermore, the transfer speed determiner 335 performs control so that in the registration unit R, rotation is made at the first speed V1 while the print sheet 10 is passing through the range from the intermediate entrance sensor 511 to the before-registration rollers 230*a* and 230*b*.

The scheduling unit 337 is a module configured to determine the image formation speed, the operation speed of each drive unit, the operation order, and the operation timing based on the job data. Based on the schedule determined by the scheduling unit 337, the image formation controller 336*a* and the transfer drive controller 350 perform the image formation processing and transfer operation. Further, the schedule determined by the scheduling unit 337 is also input to the transfer speed corrector 338.

The transfer speed corrector 338 is a module configured to switch control of each drive unit to another based on the transfer condition for each print sheet 10 and to control the operation speed of each drive unit. Specifically, the transfer speed corrector 338 independently controls the transfer speeds of the print sheet 10 at respective points of the pickup roller 220*a*, the scraper roller 220*b*, the intermediate transfer rollers 251, 252 and 253, and the before-registration rollers 230*a* and 230*b* so that the operation speed of each drive unit synchronizes with the start and stop of the drive and the behavior, such as sudden acceleration and sudden deceleration, of the registration rollers 240*a* and 240*b* in accordance with the operation pattern determined by the transfer speed determiner 335 and the scheduling determined by the scheduling unit 337. Then, the transfer speed corrector 338 sends out the control data to the transfer drive controller 350 and the transfer drive controller 350 performs drive control within the feed route while collating the operation patterns calculated by the transfer speed determiner 335 in order to perform feed control in accordance with the schedule.

(Operation of Feed Control)

Figure 5:
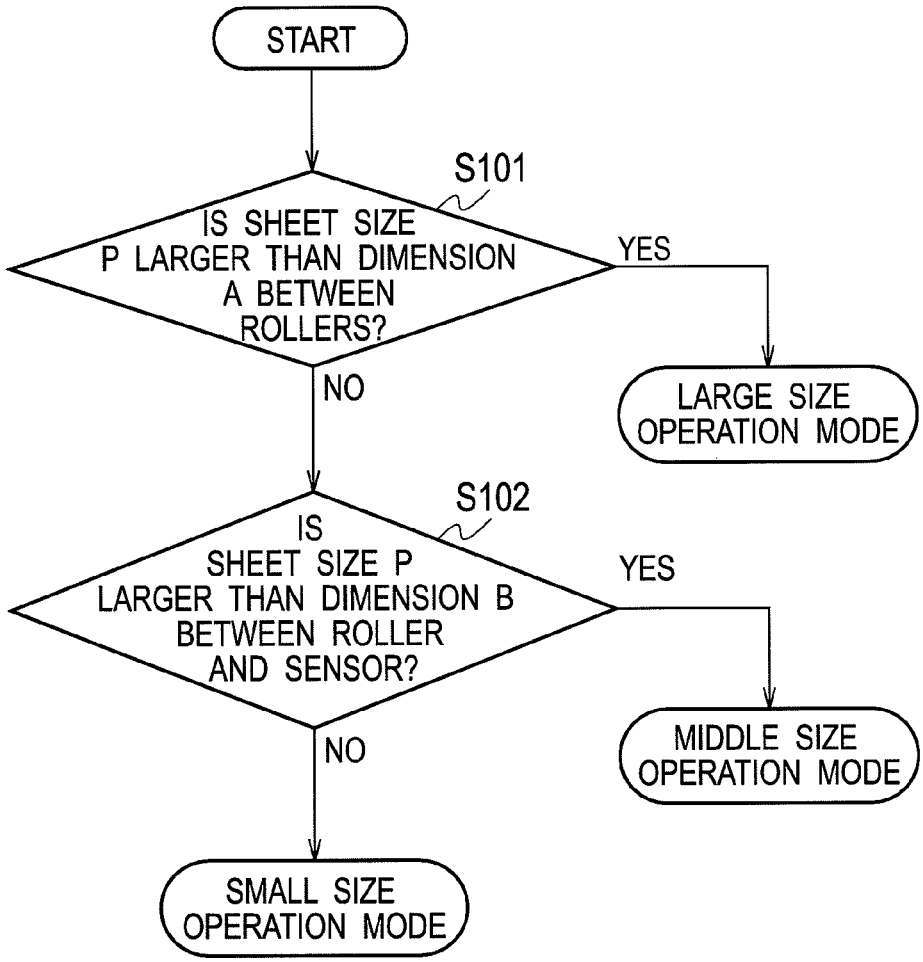
FIG. 5 is a flowchart showing an outline of transfer speed control by the processor of FIG. 3.
Figure 6:
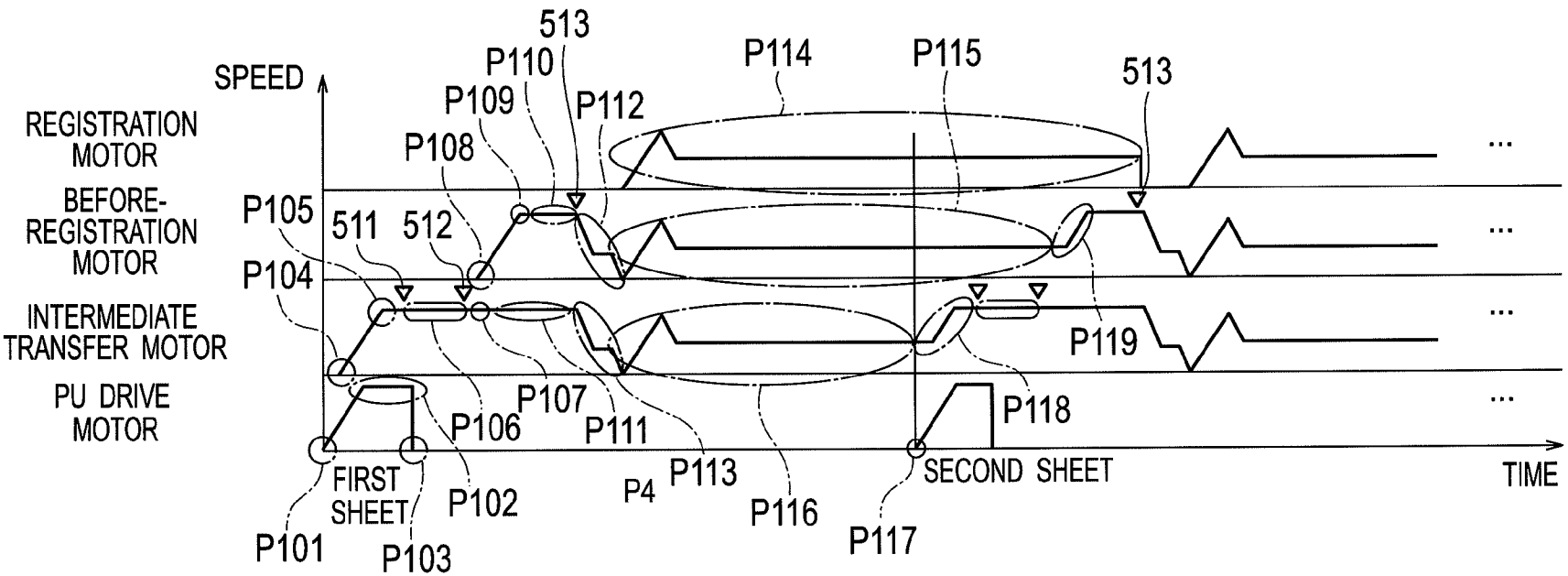
FIG. 6 is a time chart showing feed control in a large size mode by the transfer speed control of FIG. 5.
Figure 7:
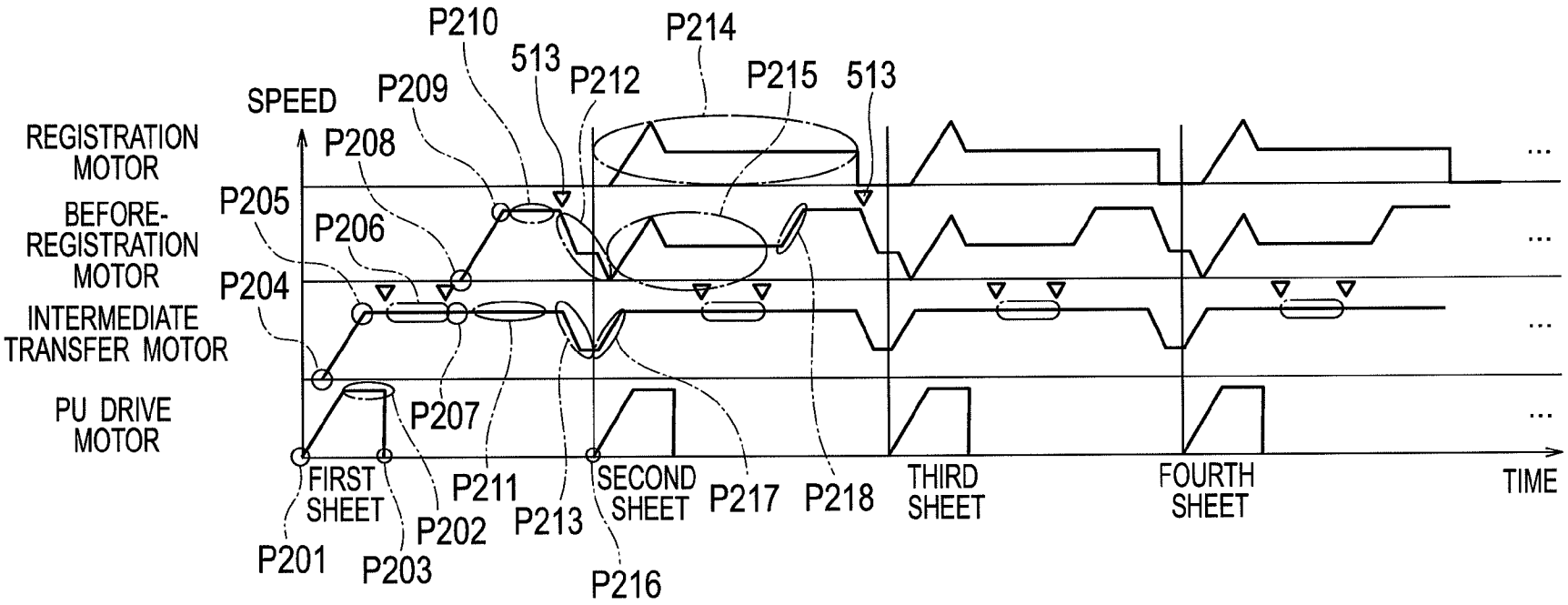
FIG. 7 is a time chart showing feed control in a middle size mode by the transfer speed control of FIG. 5.
Figure 8:
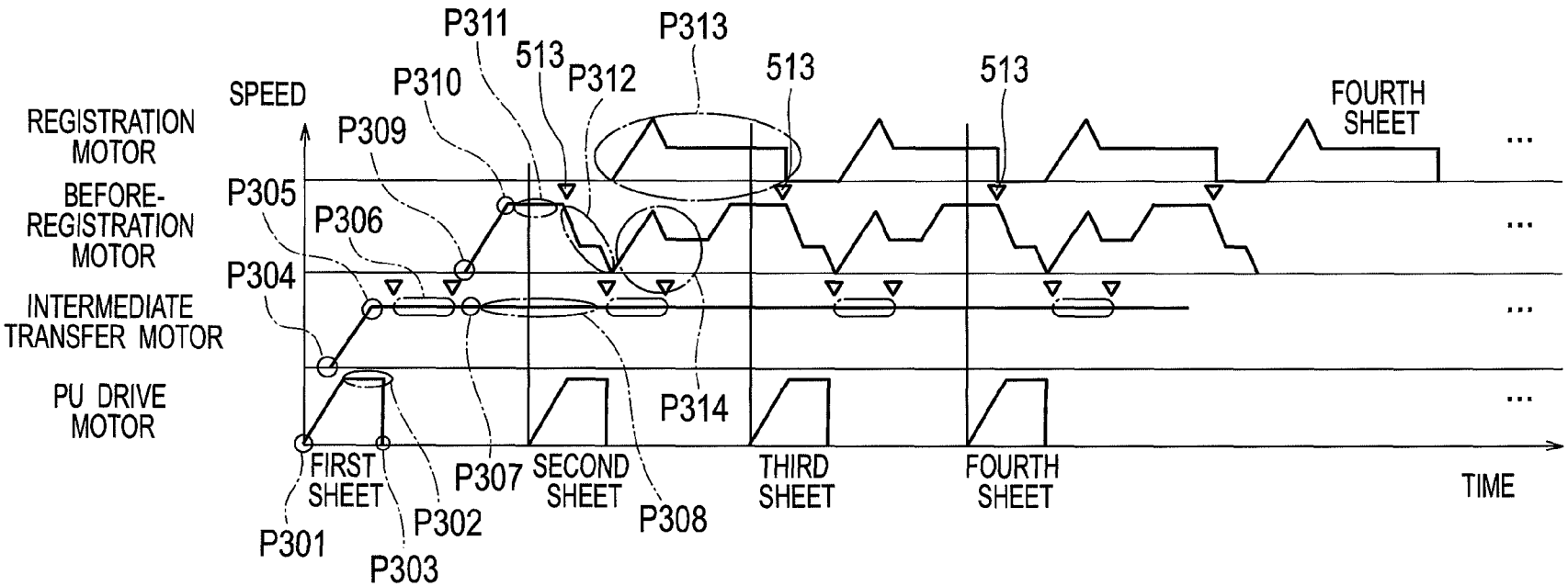
FIG. 8 is a time chart showing feed control in a small size mode by the transfer speed control of FIG. 5.

The operation of the feed control mechanism having the above configuration is explained. FIG. 5 is a flowchart showing an outline of transfer speed control by the processor 330. FIG. 6 is a time chart showing feed control in the large size mode by the transfer speed control of FIG. 5, FIG. 7 is a time chart showing feed control in the middle size mode by the transfer speed control of FIG. 5, and FIG. 8 is a time chart showing feed control in the small size mode by the transfer speed control of FIG. 5.

In the transfer speed control according to the present embodiment, the operation speed of the feed mechanism (the speed of the intermediate transfer rollers 251, 252 and 253) in the intermediate transfer motor drive unit 250 is controlled so as to be synchronized with the speed of the pickup roller 220*a* and the before-registration rollers 230*a* and 230*b* based on the operation pattern corresponding to the size of the print sheet. The operation pattern is determined based on a relationship between a distance A of the transfer route from the intermediate transfer roller 253 located at the downmost stream in the transfer direction of the print sheet 10 to the registration rollers 240*a* and 240*b*, a distance B of the transfer route from the intermediate transfer roller 253 to the registration sensor 513, and a length P in the transfer direction of the print sheet 10, which are the characteristics of the feed route FR1.

Specifically, as shown in FIG. 5, when the size of the print sheet 10 is acquired by the sheet detection module group 500 and the operation signal acquisition unit 333, first, whether or not the length P of the print sheet to be subjected to printing processing is longer than the distance A (S101). When the length P of the print sheet is longer than the distance A ("Y" at S101), the operation pattern is the operation mode of a large-sized print sheet (large size mode). On the other hand, when the length P of the print sheet is shorter than the distance A ("N" at S101), whether or not the length P of the print sheet is longer than the distance B is further determined (S102) and when the length P of the print sheet is longer than the distance B ("Y" at S102), the operation pattern is the operation mode of a middle-sized print sheet (middle size mode). On the other hand, when the length P of the print sheet is shorter than the distance B ("N" at S102), the operation pattern is the operation mode of a small-sized print sheet (small size mode). Next, the transfer speed control in each operation mode is described in detail.

(1) Operation of Large Size Mode

In the operation of the large size mode, as shown in FIG. 6, first, when job data is received, the drive of the pickup motor is started at a predetermined acceleration (in FIG. 6: P101), the pickup roller 220*a* and the scraper roller 220*b* are rotated at a predetermined speed until the intermediate entrance sensor 511 detects the front end of the print sheet 10 (in FIG. 6: P102), and both the rollers are stopped after the intermediate entrance sensor 511 detects the front end of the print sheet 10 (in FIG. 6: P103).

At this time, the intermediate transfer motor rotates the intermediate transfer rollers 253*a* and 253*b* so that the transfer speed of the print sheet 10 is the same as that of the pickup roller 220*a* and the scraper roller 220*b* after the pickup motor starts to drive (in FIG. 6: P104). In this state, after the intermediate transfer rollers 253*a* and 253*b* receive the print sheet 10 (in FIG. 6: P105), a delay or advance in the arrival time of the print sheet 10 at the before-registration rollers 230*a* and 230*b* is corrected by adjusting the rotational speed of the intermediate transfer motor (in FIG. 6: P106). Then, after the intermediate exit sensor 512 detects the front end of the print sheet 10, the rotational speed of the intermediate transfer motor is returned to a predetermined speed (in FIG. 6: P107).

Then, the intermediate transfer motor rotates the intermediate transfer rollers 251, 252 and 253 at the same speed as the transfer speed of the print sheet 10 by the before-registration rollers 230*a* and 230*b* during the period from the detection of the print sheet 10 by the registration sensor 513 to the departure of the rear end of the print sheet 10 from the intermediate transfer rollers 253*a* and 253*b* at the downstream side and passes the print sheet 10 to the before-registration rollers 230*a* and 230*b*. Specifically, when the print sheet 10 passes by the intermediate exit sensor 512, the before-registration motor starts to drive (in FIG. 6: P108) and after accelerating to a predetermined speed, receives the print sheet 10 at a predetermined speed (in FIG. 6: P109).

Then, the before-registration motor rotates the before-registration rollers 230*a* and 230*b* at a predetermined speed until the registration sensor 513 detects the front end of the print sheet 10 (in FIG. 6: P110). At this time, the intermediate transfer motor also rotates the intermediate transfer rollers 251, 252 and 253 so that the transfer speed of the print sheet 10 is the same as the speed of the before-registration rollers 230*a* and 230*b* (in FIG. 6: P111).

Further, the before-registration motor performs the push-to-align operation (in FIG. 6: P112) after the registration sensor 513 detects the front end of the print sheet 10 and forms a slack and stops the drive once after the push-to-align speed interval is exited. At this time, the intermediate transfer motor also reduces the transfer speed of the print sheet 10 by the intermediate transfer rollers 251, 252 and 253 to the push-to-align speed (in FIG. 6: P113) so that the transfer speed of the print sheet 10 is the same as the speed of the before-registration rollers 230*a* and 230*b* at the time when the registration sensor 513 detects the print sheet 10 and stops the drive once after the push-to-align speed interval is exited.

After that, the before-registration rollers 230*a* and 230*b* pass the print sheet 10 to the registration rollers 240*a* and 240*b* and the registration motor accelerates the registration rollers 240*a* and 240*b* after the registration rollers 240*a* and 240*b* sandwich the print sheet 10 and causes the registration rollers 240*a* and 240*b* to transfer the print sheet 10 to the image former at a constant speed (in FIG. 6: P114). At this time, the before-registration motor performs the same operation as that of the registration motor (in FIG. 6: P115) until the rear end of the print sheet 10 exits and the intermediate transfer motor also rotates the intermediate transfer motors 251*a* and 251*b* at the same speed as that of the before-registration rollers 230*a* and 230*b* and the registration rollers 240*a* and 240*b* during the period from the drive start time of the registration motor to the departure of the rear end of the print sheet 10 from the intermediate transfer rollers 253*a* and 253*b* at the downstream side (in FIG. 6: P116).

The timing at which the rear end of the print sheet 10 departs from the intermediate transfer rollers 253*a* and 253*b* at the downstream side can be found by calculation. In this calculation, to the time when the intermediate exit sensor 512 changes from the state of detecting the print sheet 10 to the state of not detecting the print sheet 10, the time required for the rear end of the print sheet 10 to move from the position of the intermediate exit sensor 512 to the position of the intermediate transfer rollers 253*a* and 253*b* at the downstream side by the intermediate transfer motor 253 is added.

After that, the intermediate transfer motor rotates the intermediate transfer rollers 253*a* and 253*b* (in FIG. 6: P118) in accordance with the feed start time (in FIG. 6: P117) so that the transfer speed of the print sheet 10 is the same as that of the pickup roller 220*a* and the scraper roller 220*b* and then receives the next print sheet 10. At this time, the before-registration motor accelerates to a predetermined speed (in FIG. 6: P119) to receive the next print sheet 10.

After that, the pickup motor, the intermediate transfer motor, the before-registration motor, and the registration motor repeat the above-described operations to perform sheet-passing operation. In the present embodiment, the setting is done so that the next print sheet 10 is prevented from entering the intermediate transfer rollers 251*a* and 251*b* at the upstream side until the rear end of the print sheet 10 exits from the intermediate transfer rollers 253*a* and 253*b* at the downstream side.

(2) Operation of Middle Size Mode

In the operation of the middle size mode, as shown in FIG. 7, first, when job data is received, the drive of the pickup motor is started at a predetermined acceleration (in FIG. 7: P201), the pickup roller 220*a* and the scraper roller 220*b* are rotated at a predetermined speed until the intermediate entrance sensor 511 detects the front end of the print sheet 10 (in FIG. 7: P202), and both the rollers are stopped after the intermediate entrance sensor 511 detects the front end of the print sheet 10 (in FIG. 7: P203).

At this time, after the pickup motor starts to drive (in FIG. 7: P204), the intermediate transfer motor rotates the intermediate transfer rollers 253*a* and 253*b* so that the transfer speed of the print sheet 10 is the same as that of the pickup roller 220*a* and the scraper roller 220*b*. In this state, after the intermediate transfer rollers 253*a* and 253*b* receive the print sheet 10 (in FIG. 7: P205), the rotational speed of the intermediate transfer motor is adjusted and a delay or advance in the arrival time of the print sheet 10 at the before-registration rollers 230*a* and 230*b* is corrected (in FIG. 7: P206). Then, after the intermediate exit sensor 512 detects the front end of the print sheet 10, the rotational speed of the intermediate transfer motor is returned to the predetermined speed (in FIG. 7: P207).

Then, the intermediate transfer motor rotates the intermediate transfer rollers 251, 252 and 253 at the same speed as the transfer speed of the print sheet 10 by the before-registration rollers 230*a* and 230*b* during the period from the detection of the print sheet 10 by the registration sensor 513 to the departure of the rear end of the print sheet 10 from the intermediate transfer rollers 253*a* and 253*b* at the downstream side and passes the print sheet 10 to the before-registration rollers 230*a* and 230*b*. Specifically, when the print sheet 10 passes by the intermediate exit sensor 512, the before-registration motor starts to drive (in FIG. 7: P208) and after accelerating to a predetermined speed, receives the print sheet 10 at the predetermined speed (in FIG. 7: P209).

Then, until the registration sensor 513 detects the front end of the print sheet 10, the before-registration rollers 230*a* and 230*b* are rotated at a predetermined speed (in FIG. 7: P210). At this time, the intermediate transfer motor also rotates the intermediate transfer rollers 251, 252 and 253 so that the transfer speed of the print sheet 10 is the same as the speed of the before-registration rollers 230*a* and 230*b* (in FIG. 7: P211).

Further, the before-registration motor performs the push-to-align operation after the registration sensor 513 detects the front end of the print sheet 10 (in FIG. 7: P212) to form a slack and stops the drive once after the push-to-align speed interval is exited. At this time, the intermediate transfer motor also reduces the speed of the intermediate transfer rollers 251*a* and 251*b* to the push-to-align speed so that the speed is the same as the transfer speed of the print sheet 10 by the before-registration rollers 230*a* and 230*b* (in FIG. 7: P213) during the period from the detection of the print sheet 10 by the registration sensor 513 to the departure of the rear end of the print sheet 10 from the intermediate transfer rollers 253*a* and 253*b*. Then, when receiving time information of feed start (in FIG. 7: P216) after the rear end of the print sheet 10 departs from the intermediate transfer rollers 253*a* and 253*b*, the speed reducing processing of the intermediate transfer motor is stopped, the intermediate transfer motor is accelerated to the same speed as the rotational speed of the pickup motor (in FIG. 7: P217), and then, the next print sheet 10 is received.

The print sheet 10 arrives at the registration rollers 240*a* and 240*b* and the registration motor accelerates after the registration rollers 240*a* and 240*b* sandwich the print sheet 10 and transfers the print sheet 10 to the image former at a constant speed (in FIG. 7: P214). At this time, the before-registration motor rotationally drives the before-registration rollers 230*a* and 230*b* (in FIG. 7: P215) so that the transfer speed of the print sheet 10 is the same as the speed of the registration rollers 240*a* and 240*b* until the rear end of the print sheet 10 exits. After the rear end of the print sheet 10 exits, when the intermediate exit sensor 512 detects the next print sheet 10, the before-registration motor accelerates to a predetermined speed (in FIG. 7: P218) to receive the next print sheet 10.

After that, the pickup motor, the intermediate transfer motor, the before-registration motor, and the registration motor repeat the above-mentioned operations to perform the sheet-passing operation. In the present embodiment, the setting is done so that the next print sheet 10 is prevented from entering the intermediate transfer rollers 251*a* and 251*b* at the upstream side until the rear end of the print sheet 10 exits from the intermediate transfer rollers 253*a* and 253*b* at the downstream side.

(3) Operation of Small Size Mode

In the operation of the small size mode, as shown in FIG. 8, first, when job data is received, the drive of the pickup motor is started at a predetermined acceleration (in FIG. 8: P301), the pickup roller 220*a* and the scraper roller 220*b* are rotated at a predetermined speed (in FIG. 8: P302) until the intermediate entrance sensor 511 detects the front end of the print sheet 10, and both the rollers are stopped (in FIG. 8: P303) after the intermediate entrance sensor 511 detects the front end of the print sheet 10.

At this time, after the pickup motor starts to drive (in FIG. 8: P304), the intermediate transfer motor rotates the intermediate transfer rollers 253*a* and 253*b* so that the transfer speed of the print sheet 10 is the same as that of the pickup roller 220*a* and the scraper roller 220*b*. In this state, after the intermediate transfer rollers 253*a* and 253*b* receives the print sheet 10 (in FIG. 8: P305), the rotational speed of the intermediate transfer motor is adjusted and a delay or advance in the arrival time of the print sheet 10 at the before-registration rollers 230*a* and 230*b* is corrected (in FIG. 8: P306). Then, after the intermediate exit sensor 512 detects the front end of the print sheet 10, the rotational speed of the intermediate transfer motor is returned to the predetermined speed (in FIG. 8: P307).

Then, the intermediate transfer motor rotates the intermediate transfer rollers 253*a* and 253*b* (in FIG. 8: P308) so that the transfer speed of the print sheet 10 is the same as that of the pickup roller 220*a* and the scraper roller 220*b* regardless of whether or not the rear end of the print sheet 10 exits from the intermediate transfer rollers 253*a* and 253*b* located at the downstream side and passes the print sheet 10 to the before-registration rollers 230*a* and 230*b*.

On the other hand, when the print sheet 10 passes by the intermediate exit sensor 512, the before-registration motor starts to drive (in FIG. 8: P309) and after accelerating to a predetermined speed, receives the print sheet 10 at the predetermined speed (in FIG. 8: P310). Then, the before-registration rollers 230*a* and 230*b* are rotated at a predetermined speed (in FIG. 8: P311) until the registration sensor 513 detects the front end of the print sheet 10.

Further, after the registration sensor 513 detects the front end of the print sheet 10, the before-registration motor performs the push-to-align operation (in FIG. 8: P312) to form a slack and stops the drive once after the push-to-align speed interval is exited. After that, the print sheet 10 arrives at the registration rollers 240*a* and 240*b* and after the registration rollers 240*a* and 240*b* sandwich the print sheet 10, the registration motor 240 accelerates and transfers the print sheet 10 to the image former at a constant speed (in FIG. 8: P313). At this time, the before-registration motor rotationally drives the before-registration rollers 230*a* and 230*b* (in FIG. 8: P314) so that the transfer speed of the print sheet 10 is the same as the speed of the registration rollers 240*a* and 240*b* until the next print sheet 10 is detected by the intermediate exit sensor 512.

On the other hand, the intermediate transfer rollers 251, 252 and 253 continue to rotate at the same sheet transfer speed as that of the pickup roller 220*a* and the scraper roller 220*b* (in FIG. 8: P308), receive the next print sheet 10, and pass the print sheet 10 to the before-registration rollers 230*a* and 230*b*. After that, the pickup motor, the intermediate transfer motor, the before-registration motor, and the registration motor repeat the above-mentioned operations to perform the sheet-passing operation.

(Correction Control of Delay or Advance in Arrival Time at Before-Registration Roller)

Figure 9:
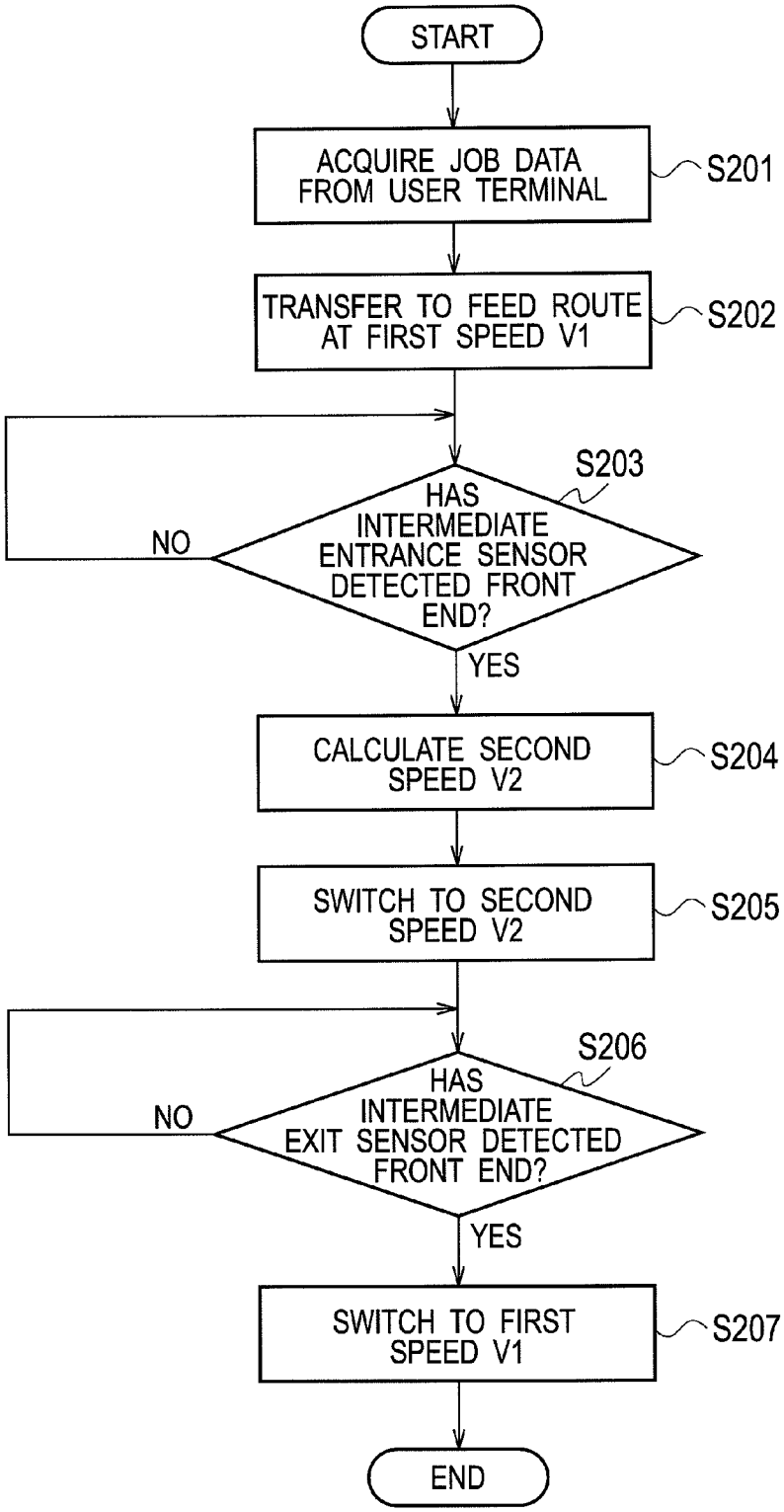
FIG. 9 is a flowchart showing correction control of the arrival time of a print sheet at an intermediate transfer roller by the processor of FIG. 3.
Figure 10:
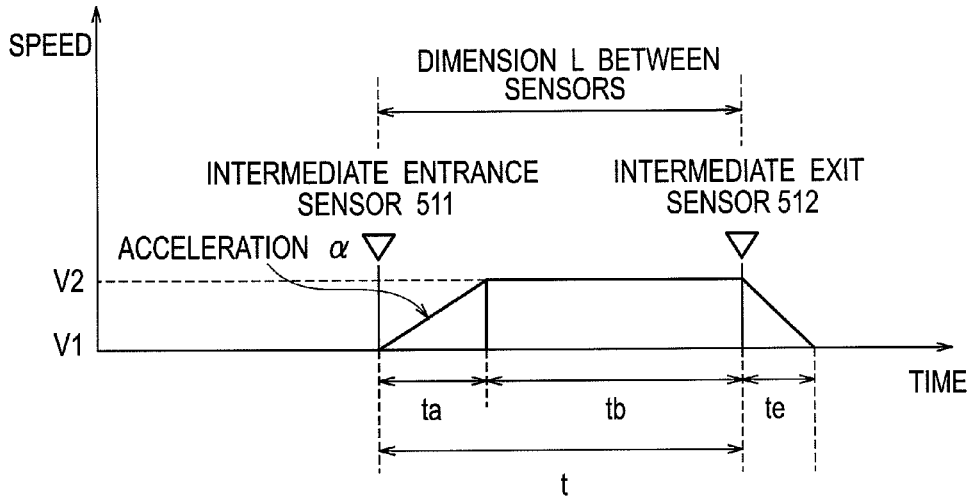
FIG. 10 is a time chart showing a state where the intermediate transfer motor changes from a first speed to a second speed by the feed control of FIG. 9.
Figure 11:
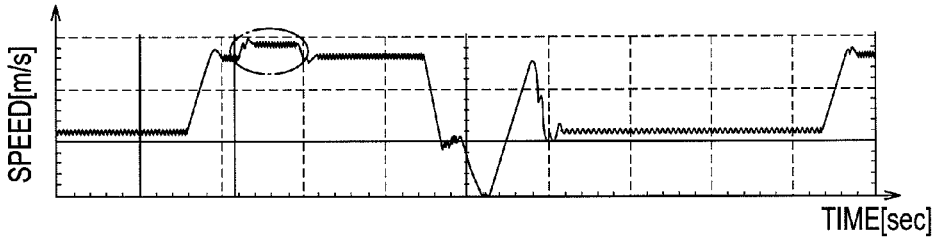
FIG. 11 is a time chart showing a change in speed of the intermediate transfer motor by the feed control of FIG. 9.

Next, control of a delay or advance in the arrival time at the before-registration rollers 230*a* and 230*b* is explained. FIG. 9 is flowchart showing correction control of the arrival time of the print sheet 10 at the intermediate transfer rollers 251, 252 and 253 by the processor 330, FIG. 10 is a time chart showing the state where the intermediate transfer motor changes from the first speed to the second speed by the control of the processor 330, and FIG. 11 is a time chart showing the change in the speed of the intermediate transfer motor by the control of the processor 330. FIG. 10 is an enlarged view of the range surrounded by the dotted line in FIG. 11.

First, the transfer speed determiner 335 transmits control data of the speed V2 to the transfer speed corrector 338. By switching the speed of the intermediate transfer rollers 251, 252 and 253 from the reception speed V1, which is a first speed, to the corrected speed V2, which is a second speed (S205), when the time when the print sheet 10 is detected by the intermediate entrance sensor 511 is delayed, the transfer speed corrector 338 increases the rotational speed so that the corrected speed V2 is greater than the reception speed V1 and corrects the timing of the arrival of the print sheet 10 at the before-registration rollers 230*a* and 230*b* as shown in FIG. 10 and FIG. 11. On the other hand, when the time when the print sheet 10 is detected by the intermediate entrance sensor 511 is advanced, the transfer speed corrector 338 decreases the rotational speed so that the corrected speed V2 is less than the reception speed V1 and corrects the arrival time of the print sheet 10 at the before-registration rollers 230*a* and 230*b*.

After that, the intermediate transfer rollers 251, 252 and 253 transfer the print sheet 10 at the predetermined second speed V2 until the intermediate exit sensor 512 detects the front end of the print sheet 10 ("N" at step S206) and when the intermediate exit sensor 512 detects the front end of the print sheet 10 ("Y" at step S206), the speed of the intermediate transfer roller is switched to the first speed V1 at that timing (S207). Further, the transfer speed corrector 338 passes the print sheet 10 to the before-registration rollers 230*a* and 230*b* at the first speed V1 while the print sheet 10 is passing through the range from the intermediate entrance sensor 511 to the before-registration rollers 230*a* and 230*b*.

Specifically, the first and second speeds V1 and V2 are determined as shown in FIG. 10. Here, in FIG. 10, it is assumed that the time difference between the time when the intermediate entrance sensor 511 detects the front end of the print sheet 10 and the arrival time scheduled initially is "t", the distance on the transfer route between the intermediate entrance sensor 511 and the intermediate exit sensor 512 is "L", and the acceleration of the intermediate transfer motor is a. The distance "L" is a value unique to the device, which is determined by the installation position of the intermediate entrance sensor 511 and the intermediate exit sensor 512 and the acceleration a is a value unique to the device, which is determined by the performance of the intermediate transfer motor drive unit 250. It is assumed that the time required to accelerate (decelerate) to V2 from the start point of the time information t is "ta", the duration time of the constant speed of V2 after "ta" is "tb", and the time required to decelerate (accelerate) to the original speed V1 from the time when the intermediate exit sensor 512 is passed by is "te".

Then, the relationship between these values is represented by the following quadratic equation, $$(V2)^2-(2V1+2\alpha t)V2+\{(V1)^2+2\alpha L\}.=0 \quad (1)$$

By solving this quadratic equation, the corrected speed V2 is obtained as $$V2=V1+\alpha t-\sqrt{(V1+\alpha t)^2-\{(V1)^2+2\alpha L\}}. \quad (2)$$

That is, in the speed correction method of the intermediate transfer motor, the time when the intermediate entrance sensor 511 detects the front end of the print sheet 10 is taken to be the start point of time and then the second speed V2 is determined, and the print sheet 10 is transferred to the intermediate exit sensor 512 at the second speed V2, and after the detection by the intermediate exit sensor 512, the speed is returned to the first speed V1. Calculation of each value is as follows.

First, when the print sheet is detected without an advance or delay, $$t=\frac{L}{V1} \quad (3)$$

is established and the first speed V1 and the distance L are values unique to the device, and therefore, t is also obtained as a value unique to the device. Then, when there occurs a delay or advance, the second speed V2 is determined using the equation (2). Then, the time "ta" required to accelerate/decelerate at the time of start of correction is found as follows, $$ta=\frac{V2-V1}{\alpha}. \quad (4)$$

Then, the relationship between these values is recorded as each operation pattern and at the same time, it may be also possible to appropriately update by periodic feedback processing etc. in accordance with the change in the values unique to the device, such as wear and deterioration of the mechanisms and the change in the performance of motors. It may be also possible to perform such feedback processing of the operation pattern at the time of periodic maintenance or to automatically perform when the device is activated/deactivated etc.

(Functions and Effects)

According to the present embodiment as described above, the operation pattern is determined in accordance with the size of the print sheet 10 and the characteristics of the feed route and with the determined operation pattern, the rotation of the intermediate transfer rollers 251, 252 and 253 is caused to follow the rotation of the pickup roller 220*a*, the scraper roller 220*b*, the before-registration rollers 230*a* and 230*b*, and the registration roller. Because of this, it is possible to prevent the occurrence of back tension that acts on the print sheet 10 and at the same time, to cause the before-registration rollers 230*a* and 230*b* to perform only the "push-to-align correction control", and as a result, it is possible to increase the speed of processing performance of the whole of the printer 100.

Specifically, in the case of the large-sized print sheet 10, during the period from the detection of the print sheet 10 by the registration sensor 513 to the drive start time of the registration roller, that is, before the registration roller nips the print sheet 10, the intermediate transfer rollers 251, 252 and 253 are rotated at the same speed as that of the before-registration rollers 230*a* and 230*b*. Because of this, it is possible to prevent the occurrence of back tension that acts on the print sheet 10 by the before-registration rollers 230*a* and 230*b* and the intermediate transfer rollers 251, 252 and 253.

Further, during the period from the drive start time of the registration roller to the departure of the rear end of the print sheet 10 from the intermediate transfer rollers 251, 252 and 253, that is, while the intermediate transfer rollers 251, 252 and 253, the before-registration rollers 230*a* and 230*b*, and the registration roller sandwich one print sheet 10, the intermediate transfer rollers 251, 252 and 253 are rotated at the same speed as that of the before-registration rollers 230*a* and 230*b* and the registration roller by causing the intermediate transfer rollers 251, 252 and 253 to follow the rotation of the before-registration rollers 230*a* and 230*b* and the registration roller. Due to this, it is possible to prevent the occurrence of back tension that acts on the print sheet 10 by the three kinds of rollers.

On one hand, in the case of the middle-sized print sheet 10, one print sheet 10 is not nipped by the registration roller and the intermediate transfer rollers 251, 252 and 253 at the same time, and therefore, before the registration sensor 513 detects the print sheet 10, the intermediate transfer rollers 251, 252 and 253 are rotated at the same speed as that of the before-registration rollers 230*a* and 230*b* by causing the intermediate transfer rollers 251, 252 and 253 to follow the rotation of the before-registration rollers 230*a* and 230*b*. Due to this, it is possible to prevent the occurrence of back tension that acts on the print sheet 10 by the before-registration rollers 230*a* and 230*b* and the intermediate transfer rollers 251, 252 and 253.

On the other hand, in the case of the small-sized print sheet 10, when the before-registration rollers 230*a* and 230*b* perform the "push-to-align correction control" on the print sheet 10, the intermediate transfer rollers 251, 252 and 253 do not sandwich the print sheet 10. Because of this, it is possible to suppress the load that is applied to the print sheet 10 by receiving the next print sheet 10 with the rotational speed unchanged.

In the present embodiment, the intermediate transfer rollers 251, 252 and 253 are provided in plurality and the distance from the intermediate transfer rollers 251, 252 and 253 is set to the distance from the intermediate transfer roller 253 located at the downmost stream in the transfer direction of the print sheet 10 of the plurality of the intermediate transfer rollers 251, 252 and 253. Due to this, it is possible to appropriately prevent the occurrence of back tension by changing the operation pattern with the intermediate transfer rollers 251, 252 and 253 that sandwich the print sheet 10 to the last as a reference.

In the present embodiment, the transfer speed determiner 335 transfers the print sheet 10 at the predetermined first speed V1 by the intermediate transfer rollers 251, 252 and 253 and at the same time, corrects the arrival time of the print sheet 10 at the before-registration rollers 230*a* and 230*b* by calculating the second speed V2 based on the characteristics of the feed route in accordance with the time when the intermediate entrance sensor 511 detects the front end of the print sheet 10 and by switching the first speed V1 to the second speed V2.

Due to this, even when the arrival time of the print sheet 10 at the intermediate transfer rollers 251, 252 and 253 varies due to the thickness of the print sheet 10, the friction with the pickup unit, etc., it is possible to transfer the print sheet 10 to the before-registration rollers 230*a* and 230*b* at an appropriate timing. As a result of that, it is possible to prevent the occurrence of back tension that acts on the print sheet 10 nipped by the before-registration rollers 230*a* and 230*b* and the intermediate transfer rollers 251, 252 and 253 and at the same time, it is also possible to cause the before-registration rollers 230*a* and 230*b* to perform only the "push-to-align correction control", and therefore, it is possible to increase the speed of processing performance of the whole of the printer.

Further, in the present embodiment, after switching the first speed V1 to the second speed V2, the transfer speed determiner 335 switches the speed to the first speed V1 at the time when the intermediate exit sensor 512 detects the front end of the print sheet 10. Due to this, the print sheet 10 is nipped by the before-registration rollers 230*a* and 230*b* at the speed set initially. As a result of that, it is possible to prevent the occurrence of back tension that acts on the print sheet 10 nipped by the before-registration rollers 230*a* and 230*b* and the intermediate transfer rollers 251, 252 and 253.

Furthermore, in the present embodiment, the transfer speed determiner 335 sets the first speed while the print sheet 10 is passing through the range from the intermediate entrance sensor 511 to the before-registration rollers 230*a* and 230*b* in the feed route, and therefore, while the intermediate transfer rollers 251, 252 and 253 and the before-registration rollers 230*a* and 230*b* sandwich the print sheet 10, the print sheet 10 is transferred at the first speed V1. As a result of that, it is possible to prevent the occurrence of back tension that acts on the print sheet 10 nipped by the before-registration rollers 230*a* and 230*b* and the intermediate transfer rollers 251, 252 and 253.

The above can be said as follows from another viewpoint. That is, according to the image forming device of the present embodiment, at the time of the operation to supply a recording medium through the feed route from the feed tray to the registration roller, the transfer speeds of the recording medium at the respective points of the pickup unit and the intermediate transfer roller group are adjusted independently of another based on the relationship between the length between at least two rollers in the intermediate transfer roller group and the length in the transfer direction of the recording medium, and therefore, the relative feed speed with respect to the registration roller is adjusted and it is possible to prevent the occurrence of back tension that acts on various kinds of recording medium.

Further, according to the image forming device of the present embodiment, the recording medium, the length of which is longer than the distance from the intermediate transfer roller to the before-registration roller, is nipped at the same time by the registration roller, the before-registration roller, and the intermediate transfer roller in the above-mentioned image forming device. Because of that, in the present invention, it is possible to prevent the occurrence of back tension that acts on the recording medium by the before-registration roller and the intermediate transfer roller by causing the intermediate transfer roller to follow the rotation of the before-registration roller to make the same the rotational speed during the period from the detection of the recording medium by the registration sensor to the start of the drive of the registration roller, that is, before the registration roller nips the recording medium.

During the period from the start of the drive of the registration roller to the departure of the rear end of the recording medium from the intermediate transfer roller, that is, while the intermediate transfer roller, the before-registration roller, and the registration roller grip one recording medium, it is possible to prevent the occurrence of back tension that acts on the recording medium by the three kinds of rollers by causing the intermediate transfer roller to follow the rotation of the before-registration roller and the registration roller to make the same the rotational speed.

In particular, the transfer speed of the recording medium at the point of the intermediate transfer roller is also controlled based on the operation pattern, and therefore, it is possible to correct an advance or delay in the sheet transfer of the recording medium on the intermediate transfer roller side. As a result of that, it is possible to prevent the occurrence of back tension that acts on the recording medium between the before-registration roller and the intermediate transfer roller and at the same time, it is possible to cause the before-registration roller to perform only the "push-to-align correction control" independently of the correction of the advance or delay in the sheet transfer of the recording medium by the intermediate transfer roller, and therefore, it is possible to increase the speed of the processing performance of the whole of the printer.

That is, it is possible to increase the speed of the processing performance of the whole of the printer as well as to reduce back tension in the before-registration roller.

Further, according to the image forming device of the present embodiment, one recording medium is not nipped by the registration roller and the intermediate transfer roller at the same time in the above-mentioned image forming device, and therefore, it is possible to prevent the occurrence of back tension that acts on the recording medium by the before-registration roller and the intermediate transfer roller by causing the intermediate transfer roller to follow the rotation of the before-registration roller to make the same the rotational speed before the registration sensor detects the recording medium.

Furthermore, according to the image forming device of the present embodiment, when the recording medium is shorter in length than the distance from the intermediate transfer roller to the registration sensor in the above-mentioned image forming device, the intermediate transfer roller has not gripped the recording medium yet when the before-registration roller performs the "push-to-align correction control" on the recording medium, and therefore, it is possible to receive the next recording medium by leaving the rotation at the same speed and to suppress the load applied to the recording medium.

Moreover, according to the image forming device of the present embodiment, even when the arrival time of the recording medium at the intermediate transfer roller varies due to the thickness of the recording medium, the friction with the pickup unit, etc., in the above-mentioned image forming device, it is possible to correct the transfer time to the original one by switching the first speed to the second speed when the arrival at the feed route is detected. As a result of that, the recording medium can be transferred to the before-registration roller at an appropriate timing, and therefore, it is possible to prevent the occurrence of back tension that acts on the recording medium nipped by the before-registration roller and the intermediate transfer roller and at the same time, to cause the before-registration roller to perform only the "push-to-align correction control" and the speed of the processing performance of the whole of the printer can be increased.

Also, according to the image forming device of the present embodiment, the speed is switched to the first speed immediately before the recording medium arrives at the before-registration roller in the above-mentioned image forming device, and therefore, the recording medium is nipped by the before-registration roller at the first speed set at first and as a result of that, it is possible to prevent the occurrence of back tension that acts on the recording medium nipped by the before-registration roller and the intermediate transfer roller.

Further, according to the image forming device of the present embodiment, the recording medium is transferred at the first speed while the intermediate transfer roller and the before-registration roller sandwich the recording medium in the above-mentioned image forming device, and therefore, it is possible to prevent the occurrence of back tension that acts on the recording medium nipped by the before-registration roller and the intermediate transfer roller.

In addition, according to the image forming device of the present embodiment, it is possible to change the operation pattern on the basis of the intermediate transfer roller that nips the recording medium to the last even when the above-mentioned image forming device has a plurality of intermediate transfer rollers, and therefore, it is possible to appropriately prevent the occurrence of back tension.

The present application claims the benefit of priority under 35 U.S.C. §119 to Japanese Patent Application No. 2011-156498, filed on Jul. 15, 2011, the entire content of which is incorporated herein by reference.

What is claimed is:

1. An image forming device having a feed route to feed a recording medium from a feed tray to a transfer route and forming an image on the recording medium transferred on the transfer route, the device comprising:

a pickup roller configured to pick up the recording medium stacked on the feed tray and to send out the recording medium to the feed route;

a registration roller configured to adjust a timing to send out a recording medium to the transfer route;

an intermediate transfer roller group configured to transfer the recording medium between the pickup roller and the registration roller within the feed route;

an operation pattern storage unit configured to store operation patterns relating to the pickup roller, the intermediate transfer roller group, and the registration roller; and a controller configured to independently control transfer speeds of the recording medium at respective points where the pickup roller and the intermediate transfer roller group are disposed based on the operation patterns, wherein the operation patterns are set based on a relationship between a distance on the transfer route among at least two rollers in the intermediate transfer roller group and a length of the recording medium in a transfer direction.

2. The image forming device according to claim 1, wherein the intermediate transfer roller group includes:

a before-registration roller adjacent to the registration roller and configured to send out a recording medium from the feed route to the registration roller; and an intermediate transfer roller configured to transfer the recording medium between the pickup roller and the before-registration roller within the feed route, wherein the arrival of the recording medium at the registration roller is detected by a registration sensor disposed upstream of the registration roller, and wherein when the length of the recording medium in the transfer direction is longer than the distance on the transfer route from the intermediate transfer roller to the before-registration roller, the operation patterns are set so as to rotate the intermediate transfer roller at the same speed as that of the before-registration roller during the period from detection of the recording medium by the registration sensor to start of driving the registration roller, and also to rotate the intermediate transfer roller at the same speed as that of the before-registration roller and the registration roller during the period from the start of driving the registration roller to departure of the rear end of the recording medium from the intermediate transfer roller.

3. The image forming device according to claim 1, wherein the intermediate transfer roller group includes:

a before-registration roller adjacent to the registration roller and configured to send out a recording medium from the feed route to the registration roller; and an intermediate transfer roller configured to transfer the recording medium between the pickup roller and the before-registration roller within the feed route, wherein the arrival of the recording medium at the registration roller is detected by a registration sensor disposed upstream of the registration roller, and wherein when the length of the recording medium in the transfer direction is shorter than the distance on the transfer route from the intermediate transfer roller to the registration roller and the length of the recording medium in the transfer direction is longer than the distance on the transfer route from the intermediate transfer roller to the registration sensor, the operation patterns are set so as to rotate the intermediate transfer roller at the same speed as that of the before-registration roller during the period from detection of the recording medium by the registration sensor to departure of the rear end of the recording medium from the intermediate transfer roller.

4. The image forming device according to claim 1, wherein the intermediate transfer roller group includes:

a before-registration roller adjacent to the registration roller and configured to send out the recording medium from the feed route to the registration roller; and an intermediate transfer roller configured to transfer the recording medium between the pickup roller and the before-registration roller within the feed route, wherein the arrival of the recording medium at the registration roller is detected by a registration sensor disposed upstream of the registration roller, and wherein when the length of the recording medium in the transfer direction is shorter than the distance on the transfer route from the intermediate transfer roller to the registration roller, the operation patterns are set so that the intermediate transfer roller passes the recording medium to the before-registration roller at a predetermined rotational speed regardless of with or without departure of the rear end of the recording medium from the intermediate transfer roller.

5. The image forming device according to claim 1, wherein the intermediate transfer roller group includes:

a before-registration roller adjacent to the registration roller and configured to send out a recording medium from the feed route to the registration roller; and an intermediate transfer roller configured to transfer the recording medium between the pickup roller and the before-registration roller within the feed route, and wherein the controller transfers the recording medium by the intermediate transfer roller at a predetermined first speed and at the same time, calculates a second speed based on the characteristics of the feed route in accordance with the time when the front end of the recording medium is detected by an intermediate entrance sensor disposed upstream of the transfer route and configured to detect the arrival of the recording medium at the feed route, and corrects the arrival time of the recording medium at the before-registration roller by switching the transfer speed of the recording medium from the first speed to the second speed.

6. The image forming device according to claim 5, wherein after switching the transfer speed of the recording medium from the first speed to the second speed, the controller switches the transfer speed of the recording medium to the first speed at the time when the front end of the recording medium is detected by an intermediate exit sensor disposed downstream of the transfer route and configured to detect passing of the recording medium from the transfer route.

7. The image forming device according to claim 5, wherein the controller sets the transfer speed of the recording medium to the first speed while the recording medium is passing through a region on the transfer route from the intermediate entrance sensor to the before-registration roller.

8. The image forming device according to claim 1, wherein the intermediate transfer roller group includes:

a before-registration roller adjacent to the registration roller and configured to send out the recording medium from the feed route to the registration roller; and a plurality of intermediate transfer rollers configured to transfer the recording medium between the pickup roller and the before-registration roller within the feed route, and wherein the distance on the transfer route between the two rollers is specified as a distance from an intermediate transfer roller located at the downmost stream in the transfer direction of the recording medium of a plurality of intermediate transfer rollers to the before-registration roller.

* * * * *